United States Patent [19]

Nakayama

[11] 4,298,826

[45] Nov. 3, 1981

[54] AUTOMATIC FLASH UNIT

[75] Inventor: Yasuo Nakayama, Tanashi, Japan

[73] Assignee: Morris Photo Ind. Co. Ltd., Kawajima, Japan

[21] Appl. No.: 87,469

[22] Filed: Oct. 22, 1979

[30] Foreign Application Priority Data

Oct. 27, 1978 [JP] Japan ..... 53-132247
Oct. 27, 1978 [JP] Japan ..... 53-132248

[51] Int. Cl.[3] ..... H05B 41/32
[52] U.S. Cl. ..... 315/151; 315/241 P
[58] Field of Search ..... 315/151, 159, 241 P; 354/33

[56] References Cited

U.S. PATENT DOCUMENTS

| | | | |
|---|---|---|---|
| 3,754,162 | 8/1973 | Katayama | 315/159 |
| 3,849,703 | 11/1974 | Shimamura et al. | 315/151 |
| 3,864,600 | 2/1975 | Schneider | 315/151 |
| 3,909,667 | 9/1975 | Decker | 315/151 |

*Primary Examiner*—Eugene R. La Roche

[57] ABSTRACT

A series control type automatic flash unit which is capable of achieving completely controlled flashing by controlling electrical energy supplied from a main capacitor to a discharge lamp by means of a first switching element connected in series with the discharge lamp. A series circuit of a second switching element conducted by a light control signal derived from light control means and a commutation capacitor is connected in parallel with the series circuit of the discharge lamp and the first switching element, and the commutation capacitor is charged by charging means in a predetermined polarity. This charging is performed at least prior to the state of commutation, and upon conduction of the second switching element by the light control signal, stored charges of the commutation capacitor are applied via the second switching element to the first switching element to place it in a reverse biased condition. As a consequence, the first switching element is turned OFF to stop lighting of the discharge lamp. Since the second switching element which still remains conductive at that time is connected in parallel with the discharge lamp, no unnecessary discharge current flows in the discharge lamp immediately after turning OFF of the first switching element; thus, the quantity of light emitted by the discharge lamp can be controlled with high precision.

9 Claims, 7 Drawing Figures

AUTOMATIC FLASH UNIT

BACKGROUND OF THE INVENTION

1. Field of the Invention

This invention relates to an automatic flash unit, and more particularly to a series control type automatic flash unit which permits high precision control of its quantity of light.

2. Description of the Prior Art

There have heretofore been known series control type and parallel control type automatic flash units. The parallel control type unit is one that a by pass tube is connected in parallel with a discharge lamp, and this type of flash unit discharges all charges stored in a main capacitor in one flashing regardless of the quantity of light output from the discharge lamp and hence does not make effective use of electrical energy; namely, the parallel control type unit has the defect that the number of times of flashing per unit time is small. In contrast thereto, the series control type unit is one that a switching element is connected in series with a discharge lamp, and in this type of flash unit, the stored charges of the main capacitor dissipated by one flashing is proportional to the quantity of light emitted by the discharge lamp and the remaining charges are used for the next flashing. Therefore, the time intervals of flashing become short, resulting in the advantage that the number of times of flashing per unit time is large if the quantity of light for each flashing is small.

FIG. 1 is an electrical circuit diagram of the conventional series control type automatic flash unit. Reference numeral 10 indicates a DC power source; 12 designates a main capacitor; 14 identifies a trigger capacitor; 16 denotes a commutation capacitor; 18 represents a light sensitive capacitor; 20 shows a trigger switch; 22 refers to a trigger transformer; **22*a* and 22*b* indicate its primary and secondary coils; 24 designates a trigger electrode; 26 identifies a discharge lamp; 30 and 42 denote silicon controlled rectifier elements (hereinafter referred to as SCR's) formig a flip-flop; 34 and 40 represent neon tubes; 36 shows a photo cell; 38, refers to an integrating capacitor; and 28, 32 and 44 to 52** indicate resistors.

In the flash unit of FIG. 1, when turning ON the trigger switch 20 ganged with a shutter of a camera after the main capacitor 12, the trigger capacitor 14, the commutation capacitor 16 and the light measuring capacitor 18 are sufficiently charged by the DC power source 10, charges stored in the trigger capacitor 14 are discharged via the primary coil **22*a* of the trigger transformer 22 to induce a high voltage in the secondary coil 22*b*, and this high voltage is applied to the trigger electrode 24, starting ionization of a rare gas sealed in the discharge lamp 26. At the same time, charges stored in the light sensitive capacitor 18 are applied across the resistor 28, and a current is applied via the resistor 32 and the neon tube 34 to the gate of the SCR 30 to conduct it, causing the discharge lamp 26 to start discharging. Simultaneously with turning ON of the trigger switch 20, a voltage by the stored charges of the light sensitive capacitor 18 is provided to a light sensitive circuit comprised of the photo cell 36 and the integrating capacitor 38, so that when the resistance value of the photoelectric conductor 36 receiving a reflected light (composed of light by flashing of the discharge lamp 26 and natural light) from a camera subject decreases with the quantity of light received, charging of the integrating capacitor 38 is started in accordance with a time constant dependent upon the resistance value of the photo cell 36 and the capacitance of the integrating capacitor 38. When the charging voltage of the integrating capacitor 38 reaches a firing voltage of the neon tube 40, the neon tube 40 is lit, applying a current to the gate of the SCR 42 to conduct it. Upon conduction of the SCR 42, the stored charges of the commutation capacitor 16 are provided to the SCR 30 to make its anode negative, so that the SCR 30 is turned OFF to cut off the current flowing in the discharge lamp 26**, thus stopping it from lighting.

The resistance value of the photo cell 36 varies with the distance and the intensity of the reflected light from the subject, that is, the distance to the subject, and the intensity of the natural light, and the quantity of stored charges of the integrating capacitor 38 necessary for turning ON the neon tube 40 is predetermined to correspond to a proper exposure of a film used. Accordingly, the time from the moment of conduction of the SCR 30 to start discharging of the discharge lamp 26 to the moment of turning OFF of the SCR 30 to stop discharging of the discharge lamp 26 is controlled in accordance with the proper exposure of the film; namely, the quantity of light irradiating the subject by the discharge lamp 26 is automatically varied with the distance to the subject and the brightness thereof.

With the conventional automatic flash unit of such a construction as described above, when the SCR 42 is conducted by a light control signal from the light sensitive circuit to thereby turn OFF the SCR 30, the discharge and the re-charging current of the commutation capacitor flow through the discharge lamp 26 to cause unnecessary radiation of light, resulting in the defect of a momentary increase in the quantity of light emitted by the discharge lamp 26. This unnecessary radiation of light amounts, in terms of the quantity of light, to as large a guide number (GNO) as 3 to 5 (in the case of the film sensitivity being ASA100). In experiments of controlling the exposure, for example, to F2 through utilization of the conventional automatic flash unit, the abovesaid radiation of light caused a marked increase in the quantity of light from the discharge lamp in the cases of the distance to the subject being short, as indicated by the broken line 54 in FIG. 2 showing the ratio of variations in the quantity of light to the distance to the subject, that is, the light control characteristic; and this increase in the quantity of light was so large as not to be negligible in practical use.

SUMMARY OF THE INVENTION

An object of this invention is to provide an automatic flash unit which eliminates such a defect of the prior art as described above to thereby avoid unnecessary radiation of light during commutation.

Another object of this invention is to provide a high precision automatic flash unit which is capable of properly controlling the quantity of light even in the case of the distance to the subject being short.

Briefly stated, in the automatic flash unit of this invention, a discharge lamp having sealed therein a rare gas, such as xenon or the like, is connected in series with a first switching element for turning ON and OFF of the discharge lamp, and a main capacitor for supplying electrical energy is connected in parallel with the series circuit via an impedance element which is a resistor or inductance. A series circuit composed of a commutation capacitor and a second switching element, which is conducted by a light control signal from light control means, is connected in parallel with the series circuit of the discharge lamp and the first switching element. Further, means is provided for charging the commutation capacitor in a polarity different from the charging polarity of the main capacitor at least prior to the start of commutation, and by this means, the commutation capacitor is charged in the abovesaid polarity. Upon conduction of the second switching element by the light control signal, charges stored in the commutation capacitor are applied via the second switching element to the first switching element to place it in a reverse biased condition, thus cutting off the first switching element to stop lighting of the discharge lamp.

Other objects, features and advantages of this invention will become more apparent from the description taken in conjuntion with the accompanying drawings.

BRIEF DESCRIPTION OF THE INVENTION

DESCRIPTION OF THE PREFERRED EMBODIMENTS

Figure 3:
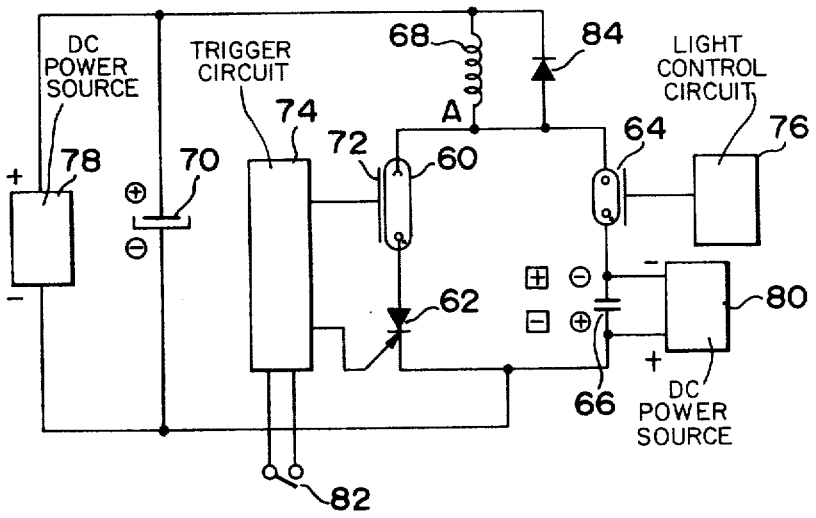
FIGS. 3 to 6 are electrical circuit diagrams respectively illustrating embodiments of this invention.

In FIG. 3 illustrating the principal part of an embodiment of this invention, reference numeral 60 indicates a discharge lamp having sealed therein xenon or like rare gas; 62 and 64 designate first and second switching elements, respectively; 66 identifies a commutation capacitor; 68 denotes an impedance element, such as a resistor or inductance; 70 represents a main capacitor; 72 shows a trigger electrode; 74 refers to a trigger circuit; 76 indicates a light control circuit; 78 and 80 designate DC power sources of different polarities; and 82 identifies a firing switch.

In the present embodiment, as shown in FIG. 3, a series circuit of the discharge lamp 60 and the first switching element 62 for turning ON and OFF the discharge lamp 60 is connected in parallel with a series of circuit of the second switching element 64 and the commutation capacitor 66, and the main capacitor 70 is connected with this parallel circuit via the inductance element 68. The trigger electrode 72 of the discharge lamp 60 and a gate terminal of the first switching element 62 are respectively supplied with a high-frequency trigger voltage and a gate pulse from the trigger circuit 74, and the second switching element 64 is supplied with a light control signal from the light control circuit 76. The DC power sources 78 and 80 are of different polarities as shown; the DC power source 78 precharges the main capacitor 70 to have a polarity (⊕, ⊖) as shown, whereas the DC power source 80 charges the commutation capacitor 66 to have a polarity (⊖, ⊕) as shown, at least prior to the start of commutation.

Upon closure of the firing switch 82 responsive to the shutter of a camera, the trigger circuit 74 is started to apply a high voltage to the trigger electrode 72 of the discharge lamp 60, whereby the rare gas sealed therein starts ionization. At the same time, the trigger circuit 74 applies the gate pulse to the first switching element 62, such as a silicon controlled rectifier element, to turn it ON, so that charges stored in the main capacitor 70 are provided to the discharge lamp 60 to activate the ionization of the rare gas, thus resulting in the discharge lamp 60 starting to light.

The light control circuit 76 measures a reflected light from a camera subject which is composed of light emitted from the discharge lamp 60 and natural light and, when the quantity of the reflected light reaches a predetermined value, provides a light control signal to the second switching element 64, such as a cold cathode thyratron or the like, to conduct it. Upon conduction of the second switching element 64, charges prestored in the commutation capacitor 66 with the polarity (⊖, ⊕) are imparted via the second switching element 64 to the series circuit of the discharge lamp 60 and the first switching element 62 to place them in reverse biased condition resulting in the first switching element 62 being turned OFF to stop lighting of the discharge lamp 60. The main capacitor 70 is generally larger in capacity than the commutation capacitor 66; therefore, if the voltage of the main capacitor 70 is applied directly to a point A immediately after the discharge lamp 60 is stopped from lighting, the first switching element 62 cannot sometimes be retained in its OFF state according to the discharge current of the commutation capacitor 66. To avoid this, the impedance element 68 is provided. A diode 84 is provided for cutting off a counter electromotive force which is yielded in the impedance element 68 due to stopping of lighting of the discharge lamp 60.

Immediately after turning OFF the first switching element 62, the rare gas in the discharge lamp 60 is still ionized, and hence the discharge lamp 60 remains conductive, so that if a current flows therein, unnecessary radiation of light takes place. In the present embodiment, however, since the second switching element 64 connected in parallel with the discharge lamp 60 still remains conductive at that time, the discharge current of the main capacitor 70 flows via the second switching element 64 to the commutation capacitor 66 in a manner to charge it in a polarity reverse from that in which it was charged before, resulting in no current being applied to the discharge lamp 60. Accordingly, when the first switching element 62 is turned OFF, that is, during commmutation, the discharge lamp does not unnecessarily increase the quantity of its light. The second switching element 64 is extinguished naturally when the commutation capacitor 66 is charged by residual charges of the main capacitor 70 to have such a polarity ( $\boxed{+}$ $\boxed{-}$ ) as shown and becomes substantially equipotential to the main capacitor 70.

With such an arrangement, the lighting time of the discharge lamp 60 substantially corresponds to the time from the moment of conduction of the first switching element 62 to start lighting of the discharge lamp 60 to the moment of conduction of the second switching element 64 to cut off the first switching element 62, thus permitting accurate control of the quantity of light.

Figure 4:
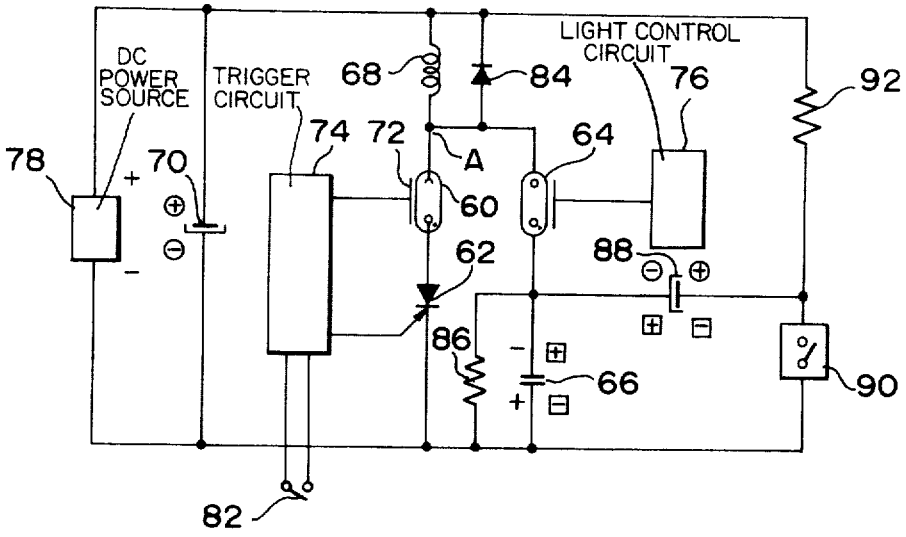

FIG. 4 is an electrical circuit diagram illustrating another embodiment of the present invention, in which parts corresponding to those in FIG. 3 are identified by the same reference numerals and in which reference numerals 86 and 92 indicate resistors, 88 designates an auxiliary commutation capacitor and 90 identifies a third switching element.

In the present embodiment, as illustrated in FIG. 4, a series circuit of the impedance element 68 which is a resistor or inductance, the discharge lamp 60 and the first switching element 62 is connected in parallel with the main capacitor 70, and the series circuit of the second switching element 64 and the commutation capacitor 66 is connected in parallel with the series circuit of the discharge lamp 60 and the first switching element 62. To the commutation capacitor 66 are connected in parallel the resistor 86 and a series circuit of the auxiliary commutation capacitor 88 and the third switching element 90, and the connection point between the auxiliary commutation capacitor 88 and the third switching element 90 is connected via the resistor 92 to the plus side of the DC power source 78. As is the case with the foregoing embodiment, a high-frequency trigger voltage and a gate pulse are respectively applied to the trigger electrode 72 of the discharge lamp 60 and the gate terminal of the first switching element 62 from the trigger circuit 74, and a light control signal is provided to the second switching element 64 from the light control circuit 76.

Now, let it be assumed that charges are sufficiently stored, by the DC power source 78 connected in parallel with the main capacitor 70, in the main capacitor 70 and the auxiliary commutation capacitor 88 in such a plurality (⊕, ⊖) as shown, and that the commutation capacitor 66 is held in a non-charged state by the resistor 86. Upon closure of the firing switch 82 responsive to the camera shutter, the trigger circuit 74 is started to apply a high voltage to the trigger electrode 72 of the discharge lamp 60, thereby starting ionization of the rare gas sealed in the discharge lamp 60. At the same time, the gate pulse is applied from the trigger circuit 74 to the first switching element 62 to turn it ON, and by the stored charges of the main capacitor 70, the above-said ionization in the discharge lamp 60 is prompted to emit light. The third switching element 90, which is a mechanical or semiconductor switch, is controlled, for example, from the outside, to be conducted at substantially the same timing as or earlier than the conduction of the first switching element 62; consequently, one part of the stored charges of the auxiliary commutation capacitor 88 is discharged via the third switching element 90 and the commutation capacitor 66, charging the latter in such a polarity (−, +) as shown. That is, one part of the charges stored in the auxiliary commutation capacitor 88 is transferred to the commutation capacitor 66. At that moment, the discharge lamp 60 is lit completely.

The light control circuit 76 measures the reflected light from the subject which is composed of the light directed thereto from the discharge lamp 60 and the natural light and, when the quantity of the reflected light reaches a predetermined value, provides a light control signal to the second switching element 64 to conduct it. Upon conduction of the second switching element 64, the charges stored in the commutation capacitor 66 in the polarity (−, +) are applied via the second switching element 64 to the series circuit of the discharge lamp 60 and the first switching element 62 to place them in a reversed biased condition, resulting in the first switching element 62 being turned OFF to stop the discharge lamp 60 from lighting.

Directly after turning OFF of the first switching element 62, the rare gas in the discharge lamp 60 is still ionized to keep the discharge lamp 60 conductive, so that if a current is supplied thereto, unnecessary radiation of light occurs. As will be appreciated from the arrangement of the present embodiment, however, the discharge current of the main capacitor 70 immediately after turning OFF of the first switching element 62 flows, via the second switching element 64 which is sufficiently lower in impedance than the discharge lamp 60, to the commutation capacitor 66 and the auxiliary commutation capacitor 88 to charge them in the polarity reverse from that in which they were charged before, so that no current flows in the discharge lamp 60. As a consequence, the discharge lamp 60 does not perform the unnecessary radiation at the time of turning OFF of the first switching element 62. The second switching element 64 is extinguished naturally when the commutation capacitor 66 and the auxiliary commutation capacitor 88 are charged in such a polarity ( + , − ) as shown, by residual charges of the main capacitor 70 up to a potential substantially equal to that of the main capacitor 70, and thereafter the commutation capacitor 66 is discharged via the resistor 86 to return to the substantially non-charged initial state.

With the above arrangement, the lighting time of the discharge lamp 60 substantially coincides with the period from the moment of conduction of the first switching element 62 to start lighting of the discharge lamp 60 to the moment of conduction of the second switching element 64 to turn OFF the first switching element 62, thus ensuring accurate control of the quantity of light emitted by the discharge lamp 60.

In FIG. 4, the impedance element 68 and the diode 84 perform the same functions as those in FIG. 3.

Figure 5:
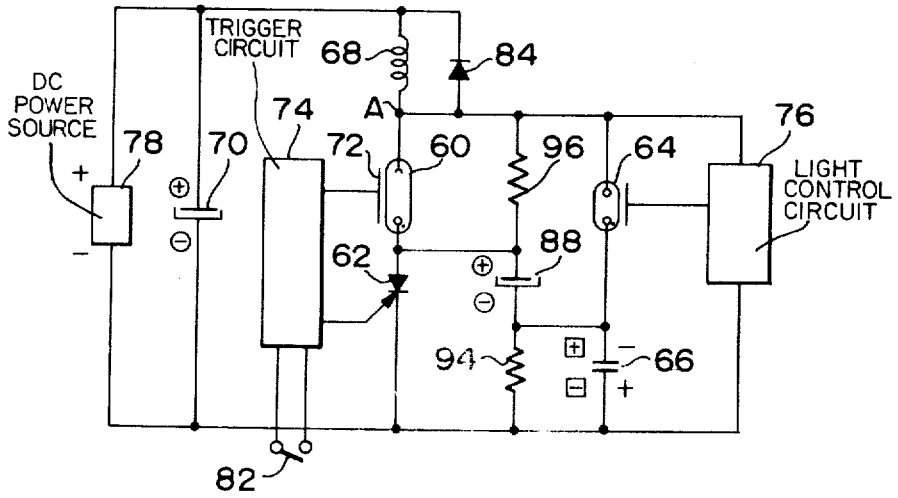

FIG. 5 is an electrical circuit diagram illustrating another embodiment of this invention, in which parts corresponding to those in FIGS. 3 and 4 are identified by the same reference numerals and in which reference numerals 94 and 96 indicate resistors. The present embodiment differs from the embodiment of FIG. 4 in that the transfer of charges from the auxiliary commutation capacitor 88 to the commutation capacitor 66 is carried out by the first switching element 62 which turns ON and OFF the discharge lamp 60, instead of using such a specially-provided switching element 90 as shown in FIG. 4. To perform this, a series circuit of the auxiliary commutation capacitor 88 and the resistor 94 is connected in parallel with the first switching element 62; the connection point between the auxiliary commutation capacitor 88 and the resistor 94 is connected to the connection point between the second switching element 64 and the commutation capacitor 66, and the resistor 96 for charging the auxiliary commutation capacitor 88 is connected between one end of the auxiliary commutation capacitor 88 and the plus side of the DC power source 78.

Upon closure of the firing switch 82 to start the trigger circuit 74, a high voltage is applied to the trigger electrode 72 of the discharge lamp 60 to start ionization of the rare gas sealed therein, and a gate pulse is provided to the first switching element 62 to turn it ON, so that ionization of the rare gas in the discharge lamp 60 is prompted by stored charges of the main capacitor 70 to start radiation. At the same time, upon conduction of the first switching element 62, one part of charges prestored in the auxiliary commutation capacitor 88 in such a polarity (⊕, ⊖) as shown are discharged via the first switching element 62 and the commutation capacitor 66, charging the latter in such a polarity (−, +) as depicted. At that moment, the discharge lamp 60 is lit completely.

As is the case with the foregoing embodiment, when the second switching element 64 is turned ON by the light control signal from the light control circuit 76, charges stored in the commutation capacitor 66 in the polarity (−, +) are applied as a reverse bias to the series circuit of the discharge lamp 60 and the first switching element 62 via the second switching element 64, with the result that the first switching element 62 is turned OFF to stop lighting of the discharge lamp 60.

Right after turning OFF of the first switching element 62, the discharge lamp 60 still remains conductive, so that if residual charges of the main capacitor 70 flows in the discharge lamp 60 in a manner to charge the series circuit of the auxiliary commutation capacitor 88 and the commutation capacitor 66, then the unnecessary radiation occurs. Also in the present embodiment, however, since the second switching element 64 is connected in parallel with the discharge lamp 60, the discharge current of the main capacitor 70 which charges the commutation capacitor 66 in the polarity opposite to that in which it was charged before mostly flows in the second switching element 64 of low impedance, with substantially no current flowing in the discharge lamp 60. This ensures to prevent unnecessary lighting of the discharge lamp 60 at the time of turning OFF of the first switching element 62. The second switching element 64 is extinguished naturally when the commutation capacitor 66 is charged by the residual charges of the main capacitor 70 in a polarity ( $\boxed{+}$ , $\boxed{-}$ ) as shown up to a potential equal to that of the main capacitor 70, and thereafter the stored charges of the commutation capacitor 66 are discharged via the resistor 94 to return to the substantially non-charged initial state.

Figure 1:
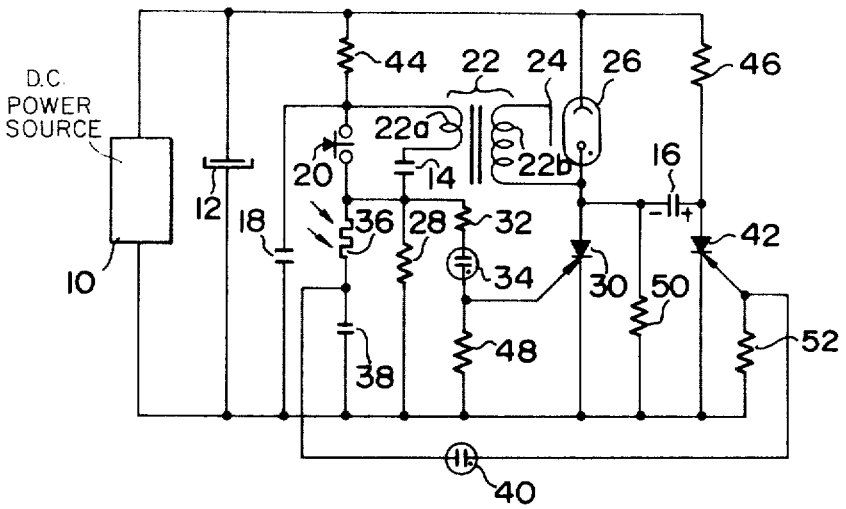
FIG. 1 PRIOR ART
FIG. 1 is an electrical circuit diagram showing a conventional automatic flash unit.
Figure 2:
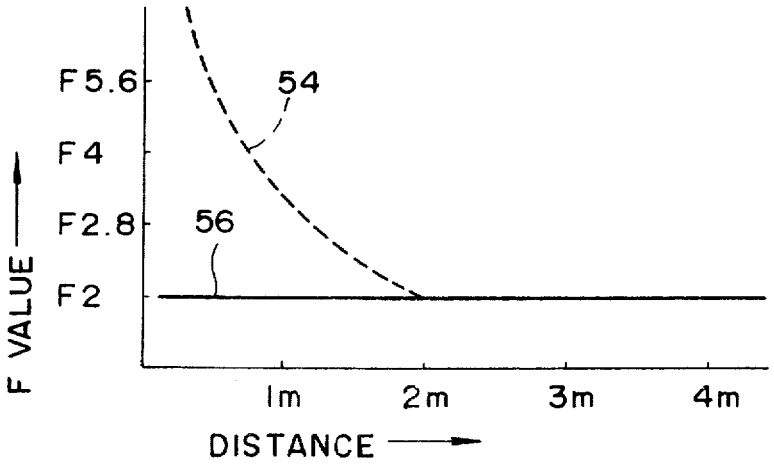
FIG. 2 is a graph showing its light control characteristic.

Also with such an arrangement, as is the case with the foregoing embodiment, the lighting time of the discharge lamp 60 substantially coincides with the period from the moment of turning ON of the first switching element 62 to start lighting of the discharge lamp 60 to the moment of turning ON of the second switching element 64 to turn OFF the first switching element 62 thus permitting accurate control of the quantity of light emitted by the discharge lamp 60. According to experiments in which the present embodiment was applied to an automatic flash unit for controlling the exposure, for example, to F2, it was ascertained that the quantity of light can properly be controlled even in the cases of the distances to the subject being short, as indicated by the solid line 56 in FIG. 2.

Figure 6:
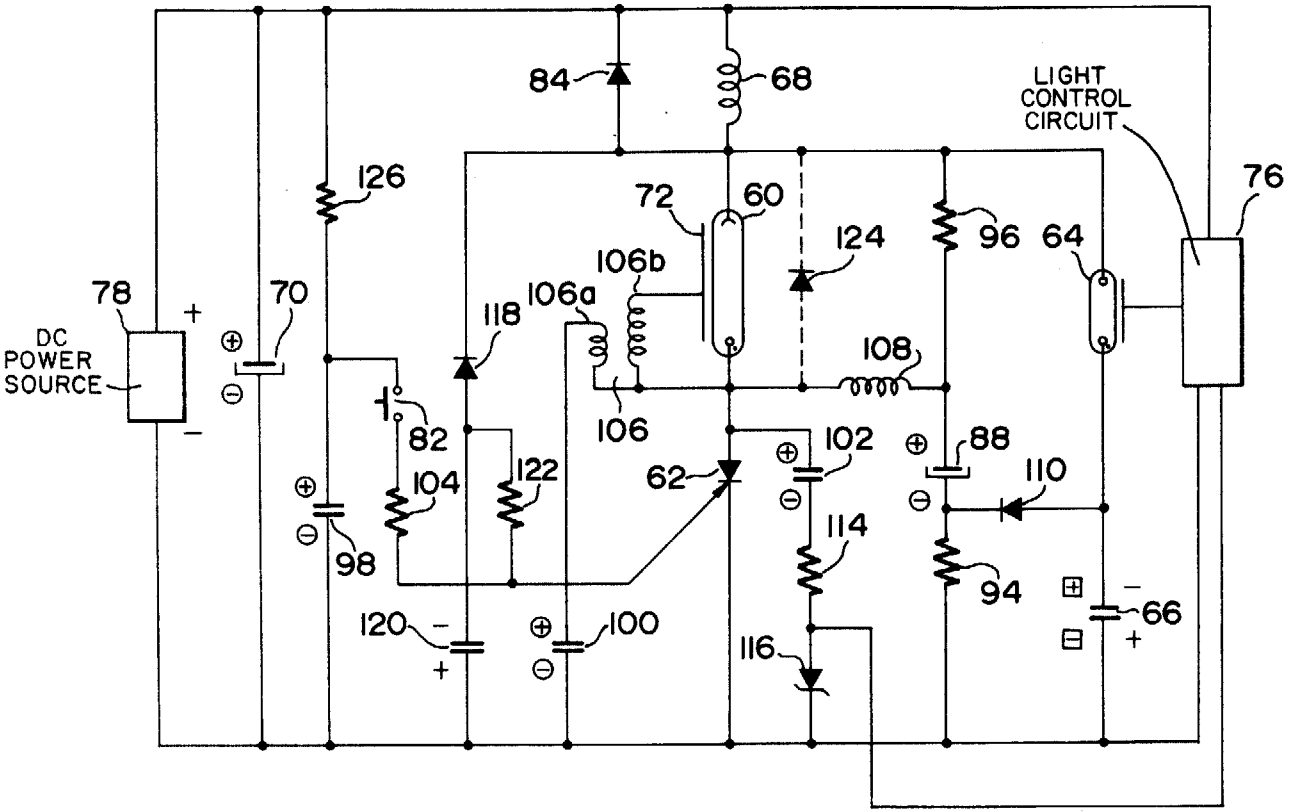

FIG. 6 is an electrical circuit diagram illustrating still another embodiment of this invention, in which parts corresponding to those in FIG. 5 are identified by the same reference numerals. In FIG. 6, reference numerals 98, 100, 102 and 120 indicate capacitors; 104, 114, 122 and 126 designate resistors; 106 identifies a trigger transformer; 106a and 106b denote its primary and secondary windings, respectively, 108 represents an inductance; 110, 118 and 124 show diodes; 116 refers to a constant-voltage element.

In the initial state, the main capacitor 70, the auxiliary commutation capacitor 88 and the capacitors 98, 100 and 102 are sufficiently charged in a polarity (⊕, ⊖) as shown, by the DC power source 78. Upon closure of the switch 82 responsive to the camera shutter, charges stored in the capacitor 98 are provided via the gate current limiting resistor 104 to the gate terminal of the first switching element 62, such as a thyristor or the like, to turn it ON. By the conduction of the first switching element 62, charges stored in the trigger capacitor 100 are applied to the primary winding 106a of the trigger transformer 106 to induce a high voltage in the secondary winding 106b, so that the rare gas sealed in the discharge lamp 60 is ionized, starting discharging of charges of the main capacitor 70 via the impedance element 68, the discharge lamp 60 and the first switching element 62 to thereby start lighting of the discharge lamp 60. By the conduction of the first switching element 62, charges of the auxiliary commutation capacitor 88 are discharged via the inductance 108, the first switching element 62 and the diode 110 to charge the commutation capacitor 66 in such a polarity (−, +) as depicted. The charges stored in the commutation capacitor 66, that is, its charging voltage depends on voltage distribution which is determined by the capacity ratio between the auxiliary commutation capacitor 88 and the commutation capacitor 66; in the present embodiment, since a series resonance circuit of the inductance 108 and the capacitors 88 and 66 performs a voltage amplifying action, the charging voltage of the commutation capacitor 66 is made higher than its usual potential and this high potential is maintained by the diode 110.

Figure 7:
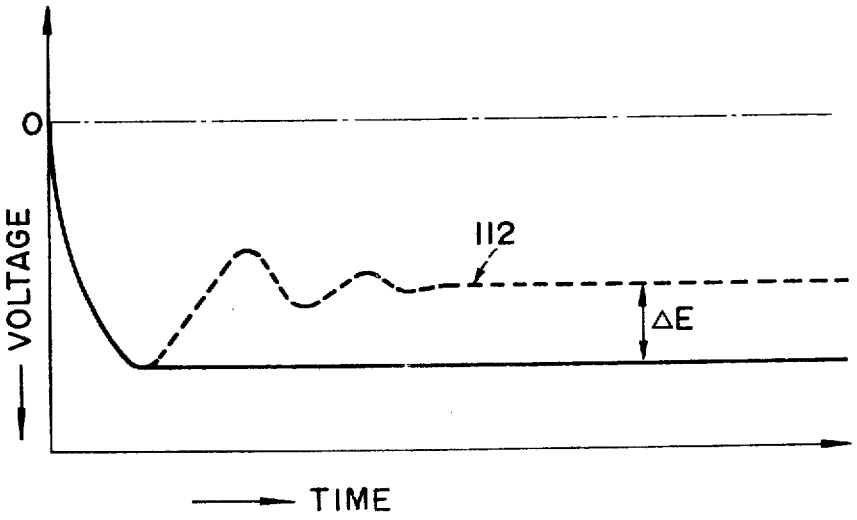
FIG. 7 is a graph explanatory of the embodiment of FIG. 6.

As shown in FIG. 7 illustrating the charging characteristic of the commutation capacitor 66, its charging potential in the case of the inductance 108 being not provided is determined in inverse relation to the capacities of the capacitors 88 and 66, as indicated by the broken line 112, whereas the charging potential in the case of the inductance 108 being provided rises (negative in this case) by the electromotive force $\Delta E$ by the inductance 108, and high potential is peak held by the diode 110. As is apparent from FIG. 7, the inductance 108 prevents abrupt charging of the commutation capacitor 66, and hence reduces the voltage increasing ratio (dV/dt) of the second switching element 64 to prevent it from misfiring (VBO firing).

By the conduction of the first switching element 62, the charges stored in the capacitor 102 are also discharged via the first switching element 62, the resistor 114 and the constant-voltage element 116, such as a Zener diode or the like, to yield a constant voltage across the constant-voltage element 116, which voltage drives the light sensitive circuit. That is, the so-called simultaneous light measurement that measurement of light is started simultaneously with control of light is achieved. When detecting that the quantity of light reflected from the subject has reached a predetermined value, the light control circuit applies a light control signal to the second switching element 64, such as a cold cathode thyratron or the like, to conduct it.

Upon conduction of the second switching element 64, the charges stored in the commutation capacitor 66 are discharged via the second switching element 64; but, in the present embodiment, the charges are provided to the series circuit of the discharge lamp 60 and the first switching element 62 in a manner to place the switching element 62 in a reverse biased condition and also to a series circuit of the diode 118 and the capacitor 120. The charges applied to the first switching element 62 turn it OFF, as described previously, whereas the charges supplied to the series circuit of the diode 118 and the capacitor 120 charge the capacitor 120 in such a polarity (−, +) as shown. As a result of this, a negative voltage is applied to the gate of the first switching element 62, ensuring to prevent re-conduction of the switching element 62 by its erroneous firing. By connecting the diode 124 in parallel with the discharge lamp 60 to have such a polarity as shown, it is possible to ensure turning OFF of the first switching element 62.

Upon turning OFF of the discharge lamp 60, the residual charges of the main capacitor 70 flow via the impedance element 68 and the second switching element 64 to charge the commutation capacitor 66 in such a polarity ( [+] , [−] ) as shown, and the charges thus stored in the commutation capacitor 66 are completely discharged via the diode 110 and the resistor 94 after natural extinction of the second switching element 64. In the present embodiment, even if the current flowing in the discharge lamp 60 tends to flow in a direction of charging the capacitors 88 and 66, since the diode 110 is connected in such a direction as to prevent it, no current flows in the discharge lamp 60. As a consequence, the quantity of light emitted from the discharge lamp is strictly limited to the value completely controlled.

In the arrangement of FIG. 6, during conduction of the first switching element 62, the transfer of charges from the auxiliary commutation capacitor 88 to the commutation capacitor 66 and the triggering of the discharge lamp 60 by the stored charges of the capacitor 100 are performed substantially simultaneously. Generally, the discharge lamp 60 needs a small amount of time for completely starting to light after triggered; therefore, also in such an arrangement, the transfer of charges can be finished before light control. To ensure the transfer of charges, for example, a switching element with a time delay circuit (not shown) is connected in series with the capacitor 100 and is turned ON with a slight time delay relative to the first switching element.

As has been described in the foregoing, the present invention is adapted so that immediately after turning OFF of the first switching element 62 for turning ON and OFF of the discharge lamp 60, a current for recharging the commutation capacitor 66 flows in the second switching element 64 connected in parallel with the discharge lamp 60; this eliminates the possibility of such unnecessary radiation as experienced in the past and enables proper control of the quantity of light even in the case of the distance to the subject is short.

It is a matter of course that the present invention is not limited specifically to the foregoing embodiments and can be modified in various ways. For example, it is optional to replace the light control circuit 76 with a timer that its CR time constant is manually variable and to generate a light control signal when a period of time predetermined by the CR time constant has passed after lighting of the discharge lamp, thereby actuating the second switching element 64.

It will be apparent that many modifications and variations may be effected without departing from the scope of the novel concepts of this invention.

What is claimed is:

1. An automatic flash unit comprising:

a discharge lamp filled with xenon or like rare gas;

a first switching element connected in series with the discharge lamp for turning it ON and OFF;

a main capacitor for supplying electrical energy to the series circuit of the first switching element and the discharge lamp via an impedance element which is a resistor or inductance;

a DC power source for charging the main capacitor;

a series circuit composed of a second switching element conducted by a light control signal from light control means and a commutation capacitor and connected in parallel with the series circuit of the discharge lamp and the first switching element; and means for charging the commutation capacitor of the series circuit in a polarity different from that in which the main capacitor is charged;

wherein stored charges of the commutation capacitor charged by the charging means are applied by the conduction of the second switching element to the first switching element to place it in a reverse biased condition, and wherein the charging means has the arrangement that an auxiliary commutation capacitor is adapted to be pre-charged by the DC power source in the same polarity as the main capacitor and is connected between the connection point of the discharge lamp and the first switching element and the connection point of the second switching element and the commutation capacitor, and that one part of stored charges of the auxiliary commutation capacitor is transferred by the conduction of the first switching element to the commutation capacitor.

2. An automatic flash unit according to claim 1, wherein the light control means is driven by a current which flows in the first switching element during the conduction thereof.

3. An automatic flash unit according to claim 1, wherein the auxiliary commutation capacitor is connected via an inductance to the connection point between the discharge lamp and the first switching element.

4. An automatic flash unit according to claim 1, wherein the auxiliary commutation capacitor is connected via a diode to the connection between the second switching element and the commutation capacitor.

5. An automatic flash unit according to claim 1, wherein the charging means has the arrangement that a DC power source of a polarity different from that of the DC power source is connected in parallel with the commutation capacitor.

6. An automatic flash unit according to claim 1, wherein a diode is connected in parallel with the discharge lamp in a direction to provide a reverse bias with respect to a discharge current of the discharge lamp.

7. An automatic flash unit according to claim 1, wherein the light control means is arranged to measure reflected light from a camera subject which is composed of light emitted from the discharge lamp and natural light and to produce the light control signal when the quantity of light reflected from the camera subject reaches a predetermined value.

8. An automatic flash unit according to claim 1, wherein the light control means has a timer circuit whose CR time constant is manually variable, and is arranged to produce the light control signal when a period of time predetermined by the CR time constant has passed after starting of lighting of the discharge lamp.

9. An automatic flash unit comprising:

a discharge lamp filled with xenon or like rare gas;

a first switching element connected in series with the discharge lamp for turning it ON and OFF;

a main capacitor for supplying electrical energy to the series circuit of the first switching element and the discharge lamp via an impedance element which is a resistor or inductance;

a DC power source for charging the main capacitor;

a series circuit composed of a second switching element conducted by a light control signal from light control means and a commutation capacitor and connected in parallel with the series circuit of the discharge lamp and the first switching element; and means for charging the commutation capacitor of the series circuit in a polarity different from that in which the main capacitor is charged;

wherein stored charges of the commutation capacitor charged by the charging means are applied by the conduction of the second switching element to the first switching element to place it in a reverse biased condition, and wherein the charging means has the arrangement that an auxiliary commutation capacitor, which is adapted to be pre-charged by the DC power source in the same polarity as the main capacitor, is connected at one end with the connection point between the second switching element and the commutation capacitor and connected at the other end with the other end of the commutation capacitor via a third switching element, and that one part of stored charges of the auxiliary commutation capacitor is transferred by the conduction of the third switching element to the commutation capacitor.

* * * * *